US010766575B2

(12) United States Patent
Maurin

(10) Patent No.: US 10,766,575 B2
(45) Date of Patent: Sep. 8, 2020

(54) FLAT ANCHOR WITH CLAWS

(71) Applicant: Alain Nicolas Maurin, Marseilles (FR)

(72) Inventor: Alain Nicolas Maurin, Marseilles (FR)

( * ) Notice: Subject to any disclaimer, the term of this patent is extended or adjusted under 35 U.S.C. 154(b) by 0 days.

(21) Appl. No.: 15/757,691

(22) PCT Filed: Sep. 7, 2016

(86) PCT No.: PCT/FR2016/000135
§ 371 (c)(1),
(2) Date: Mar. 6, 2018

(87) PCT Pub. No.: WO2017/042443
PCT Pub. Date: Mar. 16, 2017

(65) Prior Publication Data

US 2019/0039693 A1 Feb. 7, 2019

(30) Foreign Application Priority Data

Sep. 7, 2015 (FR) ..... 15 01848

(51) Int. Cl.
*B63B 21/38* (2006.01)
*B63B 21/42* (2006.01)
*B63B 21/44* (2006.01)

(52) U.S. Cl.
CPC ..... *B63B 21/42* (2013.01); *B63B 21/44* (2013.01)

(58) Field of Classification Search
CPC ..... B63B 21/24; B63B 21/26; B63B 21/29; B63B 21/30; B63B 21/34; B63B 21/38;
(Continued)

(56) References Cited

U.S. PATENT DOCUMENTS 19,659 A * 3/1858 Williams ..... B63B 21/243 114/305
1,335,816 A 4/1920 Briner
(Continued)

FOREIGN PATENT DOCUMENTS

DE 825504 C 12/1951
EP 2399818 A1 12/2011
(Continued)

OTHER PUBLICATIONS

French Search Report from FR Application No. 1501848, dated Jun. 24, 2016.

(Continued)

*Primary Examiner* — Daniel V Venne
(74) *Attorney, Agent, or Firm* — Workman Nydegger

(57) ABSTRACT

An attachment of a stockless anchor on the sea floor encourages flukes to tilt as soon as the vessel pulls away, while maintaining stability on the floor. The weight of the flukes act as a pivot with the crown of the stockless anchor that, when placed on the floor, causes the anchor to become attached by being buried in the floor when the vessel pulls away. The attachment comprises two claws fastened to the flanks of the flukes at or in close proximity of the crown on the pivot axis of the flukes, thereby enabling them to tilt and become attached immediately in the floor as soon as the anchor is placed on the floor. When the vessel pulls away the anchor is open and becomes attached immediately. An attachment to the floor avoids or reduces dragging of the anchor on the floor.

11 Claims, 9 Drawing Sheets

(58) Field of Classification Search
CPC . B63B 21/44; B63B 2021/24; B63B 2021/26; B63B 2021/262; B63B 2021/265
USPC ..... 114/294, 295, 301, 304
See application file for complete search history.

(56) References Cited

U.S. PATENT DOCUMENTS

| | | | | |
|---|---|---|---|---|
| 3,402,689 | A * | 9/1968 | James, Jr. | B63B 21/29 114/300 |
| 3,527,187 | A | 9/1970 | Towne | |
| 4,459,934 | A * | 7/1984 | Long | B63B 21/44 114/304 |
| 5,829,379 | A | 11/1998 | Von Spies | |
| 8,485,117 | B2 * | 7/2013 | Weinstein | B63B 21/46 114/299 |
| 9,745,023 | B2 * | 8/2017 | Beatty | B63B 21/46 |
| 2004/0069202 | A1 * | 4/2004 | Courtheyn | B63B 21/34 114/301 |
| 2011/0100283 | A1 * | 5/2011 | Resch | B63B 21/44 114/299 |

FOREIGN PATENT DOCUMENTS

| | | | |
|---|---|---|---|
| FR | 614469 | A | 12/1926 |
| FR | 1080883 | A | 12/1954 |
| FR | 2853879 | A1 | 10/2004 |

OTHER PUBLICATIONS

International Search Report and Written Opinion from PCT Application No. PCT/FR2016/000135, dated Jan. 2, 2017.
Office Action from corresponding CN Application No. 2016800519078, dated Feb. 27, 2020.

* cited by examiner

FIG. 10
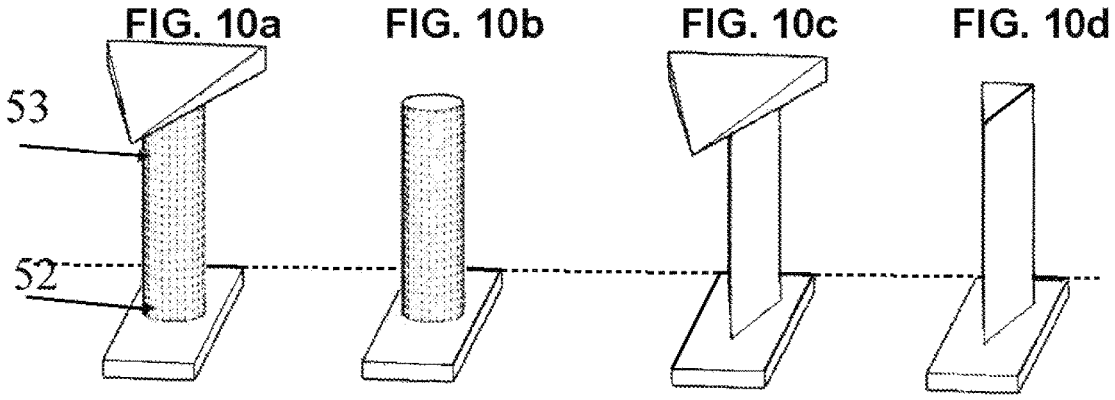
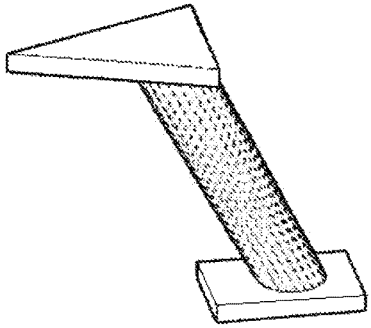
FIG. 10e
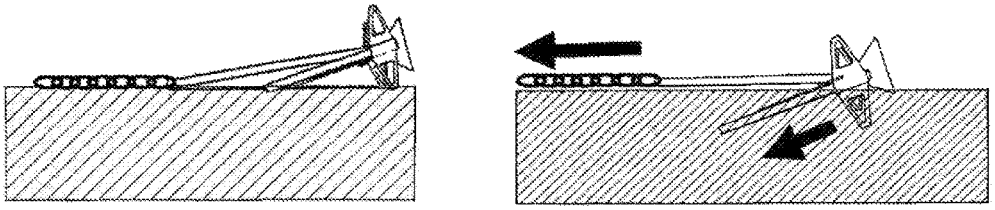
FIG. 11
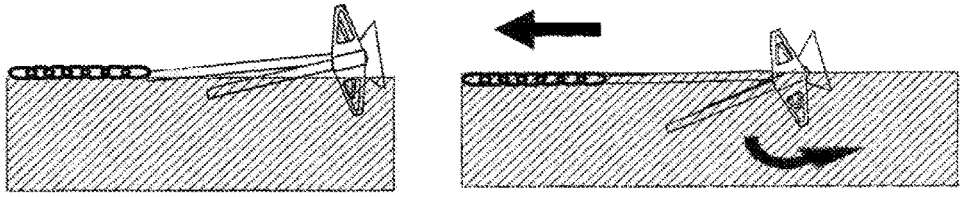
FIG. 12

FLAT ANCHOR WITH CLAWS

FIELD OF THE INVENTION

The present invention relates to attaching a stockless anchor that is already commercially available to the sea floor by encouraging titling of the flukes, thereby improving its effectiveness and stability as soon as the vessel pulls away.

BACKGROUND OF THE INVENTION

To begin with, it is the weight of the flukes (7, 8) forming a pivot with the crown (6) of the stockless anchor that, when placed on the floor, causes the anchor to become attached by becoming buried in the floor as the vessel pulls away, with this opening becoming chancy depending on the type of the floor since the anchor might drag before opening, with a vessel losing precious meters in a cove. Furthermore, dragging damages the sea floor since plowing is involved.

Inventions have attempted to solve the problem of dragging, but they differ from my invention on the following topics:

The invention of George W. Long (US) of Jul. 7, 1984 (U.S. Pat. No. 4,459,934 A) describes a device with claws (and 48) that are perpendicular to the shank and they prevent the anchor from penetrating into the floor. Their respective shapes do not enable the flukes to be kept inclined and they do not limit plowing of the anchor in the floor. They are not level with the pivot axis of the flukes but are positioned halfway between the axis and the counterweight (50). The surface of each claw (46 and 48) is perpendicular to the shank (21). The supports (34 and 36) are present over the entire width of the anchor and encourage plowing.

The invention of Mannheimeer Ankerfabrik und Ham of Dec. 15, 1926 (FR 614 469 A) describes a device with a single claw (e) per fluke face, of considerable width and fitted to the fluke that is close to the shank and perpendicular to the shank(s) so as to oppose the flukes becoming buried in the sand, and its width does not favor the plow fluke.

The invention of Ernst A. Koblenz, of Dec. 20, 1951 (DE 825 504 C) describes a device with claws (6 and 7) that is similar to the claws of Mannheimeer Ankerfabrik und Ham of Dec. 15, 1926 (FR 614 469 A).

The invention of Claude Bonet et Fils of Dec. 14, 1957 (FR 1 080 883 A) describes a device with claws P2 situated on the neck (E) behind the pivot axis of the flukes P1 and does not favor pivoting. The neck (E) is present over the entire width of the rear of the anchor, resting on the floor, and opposes penetration of the anchor, without stabilizing and without avoiding it turning over.

The invention of Guy Charles Levy (FR) of Oct. 22, 2004 (FR 2 853 879 A1) describes a crown 2 situated behind the pivot axis of the fluke, thereby being less favorable to immediate pivoting. At the end of said crown, there are claws having their plane surfaces parallel to the pivot axis of the flukes. The width of the claws (1) opposes burial of the flukes, since they are perpendicular to the direction in which the anchor moves.

BRIEF SUMMARY

The optionally removable device of the invention serves to remedy those drawbacks by enabling an anchor to attach in the floor, said anchor having two flukes (7, 8) placed on the floor, a shank (5), and a crown (6).

The claws (1 and 2) fastened to the flanks of each fluke of the crown (6) (or in the proximity thereof), said claws extending in three dimensions (x, y, z) have a vertical dimension (y) that is preponderant over the other two in order to form a shaped spur, said shaping serving to facilitate burial of the claw in the sea floor when traction (x) is applied to the anchor.

The claws (1 and 2) are placed on the tilt axis (z) of the flukes, with the ends of said claws being on the axis or in the proximity of the tilt axis of said flukes.

The claws enable the flukes to tilt quickly and to become quickly attached to the floor as soon as the vessel pulls away, the anchor opening and becoming attached very quickly in the floor by offering immediate effectiveness with greater stability (z), it no longer lies on the side, nor does it turn over when the traction on the anchor is not in alignment with the shank (5). The dragging movement is stopped quickly. The plane vertical surfaces of the claws may include openings that serve to limit their resistance in sand by allowing the sand to pass through, in the event of the traction on the anchor changing direction, with the claws thus bearing against the floor, providing a horizontal pivot axis that causes the anchor to pivot, so it no longer lies on its side. The sand that penetrates into the openings increases the resistance of the claws to being pulled out. There are four points of attachment, the two bills of the anchor and the two penetrating ends of the claws which have plane surfaces enabling the penetration angle to be conserved on all floors. Since the anchor with the claws hardly drags at all, the sea floor is preserved from the damage that would be done by a conventional anchor. Furthermore, sailors and their vessels are made safe.

Another version of the claws (FIGS. 6*a* and 6*b*) serves to pivot about a shaft present on the portion that is screwed to the anchor. This has the consequence of putting them into alignment with the flukes so as to enable the assembly to be stowed more easily.

The user can retract a claw 2 by pulling on it and causing it to pivot into a "stowage" position. Lugs then block it in openings provided for this purpose. For greater safety, the shaft may be pierced so as to enable a pin or a key (not shown) to be inserted therein.

All of the claws described below are fastened to the flanks of the flukes or in the proximity thereof, close to the pivot axis between the shank and the flukes, or at a short distance away from the axis going towards the bills of the flukes. The optionally perforated claws could thus be molded during fabrication of the anchor.

If a claw is fastened behind the pivot axis of the flukes, its high end should be machined so that a portion thereof lies in front of the pivot axis in order to ensure that the fluke pivots.

BRIEF DESCRIPTION OF THE DRAWINGS

FIG. 10*a* is a perspective view of a claw according to an embodiment.

FIG. 10*b* is a perspective view of a claw according to another embodiment.

FIG. 10*c* is a perspective view of a claw according to another embodiment.

FIG. 10*d* is a perspective view of a claw according to another embodiment.

FIG. 11 is an elevational view of a claw according to an embodiment.

FIG. 12 is an elevational view of a claw according to another embodiment.

DETAILED DESCRIPTION

Figure 1:
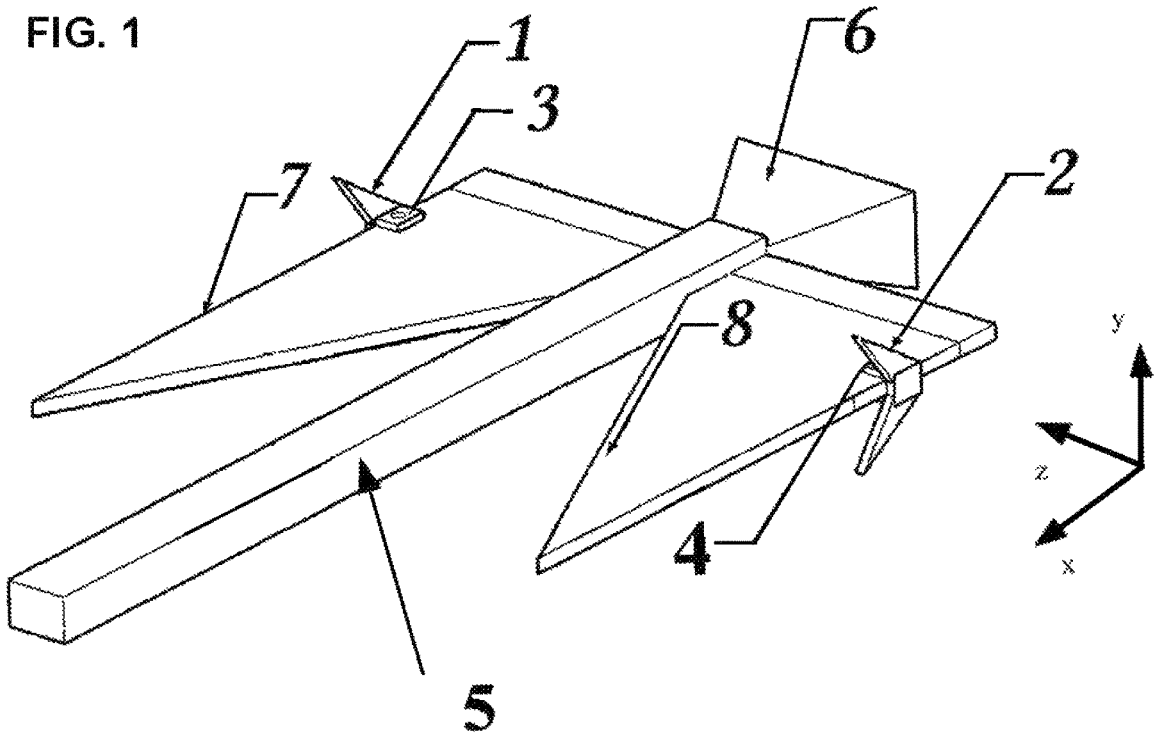
FIG. 1 is a perspective view of an anchor according to an embodiment.
Figure 2:
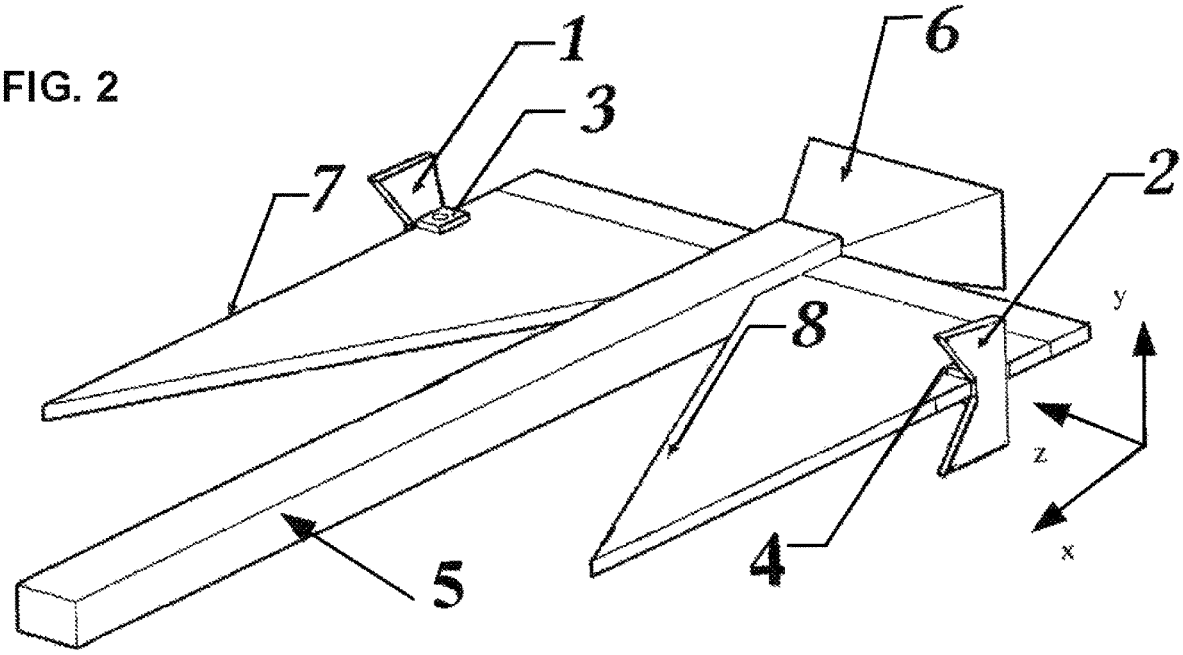
FIG. 2 is a perspective view of an anchor according to an embodiment.

In FIGS. 1 and 2

The claws (1 and 2) are placed on the pivot axis of the flukes. They may be provided with points, or they may have plane surfaces at their ends parallel to the surfaces of the flukes.

The claws (1 and 2) are secured to a channel-section member (3 and 4) that is pierced by a hole for fastening to the flukes (7 and 8).

For Temporary Fastening With the Anchor Being Drilled

The hole serves to receive a bolt for fastening the device on the fluke of the stockless anchor (7 and 8) on the anchor that is drilled.

Temporary Fastening Without Drilling the Anchor

The anchor is tapped in order to insert a screw that blocks the anchor on being tightened.

The description below relates to one of the two claws (1 and 2) present on the flukes (7 and 8), since said claws are identical.

Figure 3:
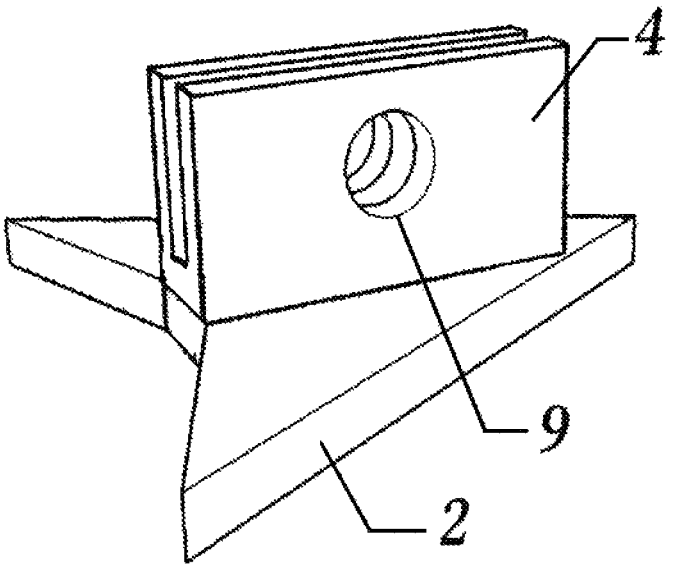
FIG. 3 is a perspective view of a claw according to an embodiment.

In FIG. 3

One claw shape has a point at its end, secured to a channel-section member (4) having a hole 9 drilled therein that is fastened on the fluke by a bolt.

Figure 4:
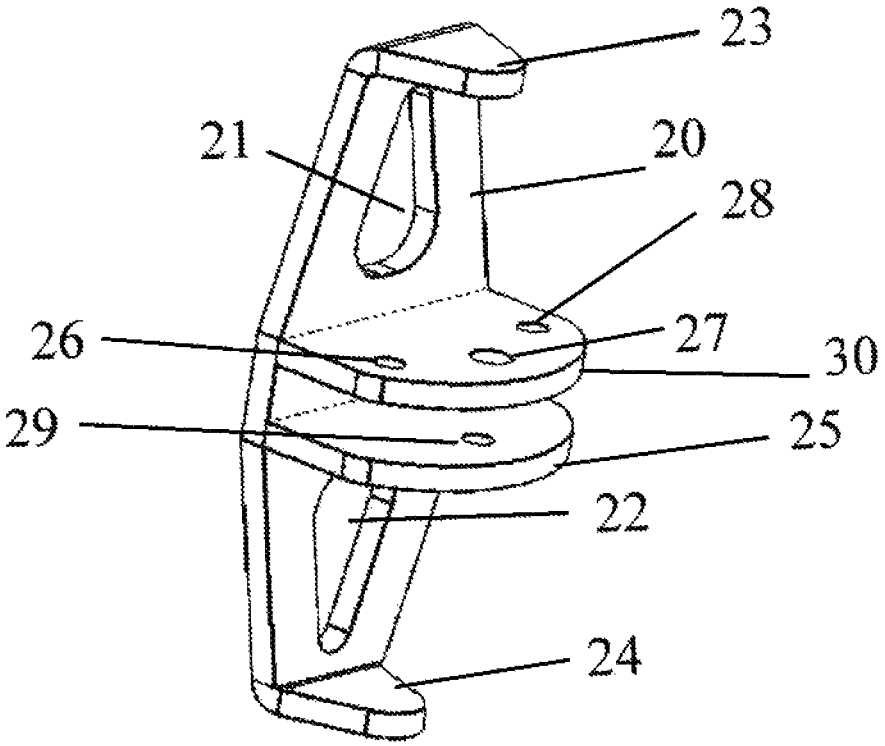
FIG. 4 is a perspective view of a claw according to an embodiment.

In FIG. 4

Another shape of a claw 1 and 2 has a plane surface (20) with openings (21 and 22), and at its ends there are two plane surfaces (23 and 24) obtained by bending the part through 90°, two tabs (25 and 30) are perpendicular to the plane surface and parallel to each other, being welded to the surface (20).

In the fastener tab (25), the hole (27) is for receiving a threaded system such as a screw that passes through the drilled anchor. A said screw is screwed into a tapped hole (29) in the fastener tab (30), two holes (26 and 28) being tapped in order to receive two screws that block the fluke on being tightened.

Figure 5:
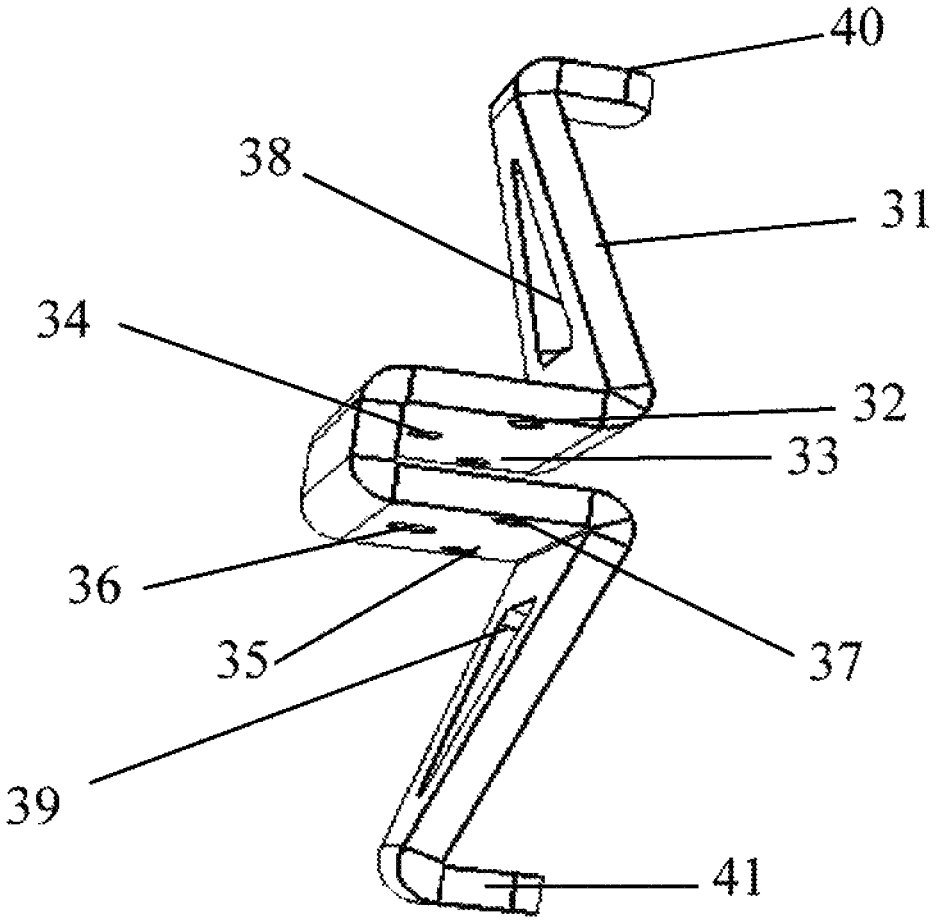
FIG. 5 is a perspective view of a claw according to an embodiment.
Figure 6A:
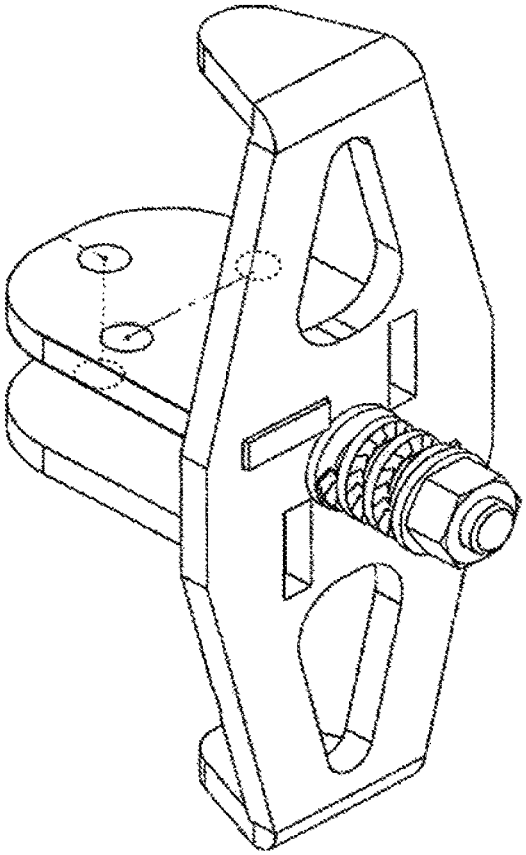
FIG. 6*a* is a perspective view of a claw according to an embodiment.
Figure 6B:
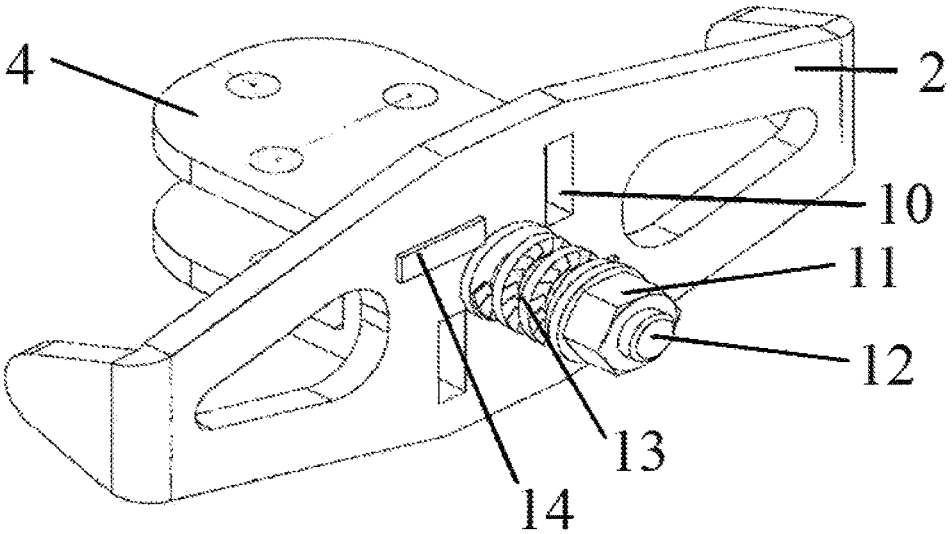
FIG. 6*b* is a perspective view of a claw according to FIG. 6*a*.
Figure 6C:
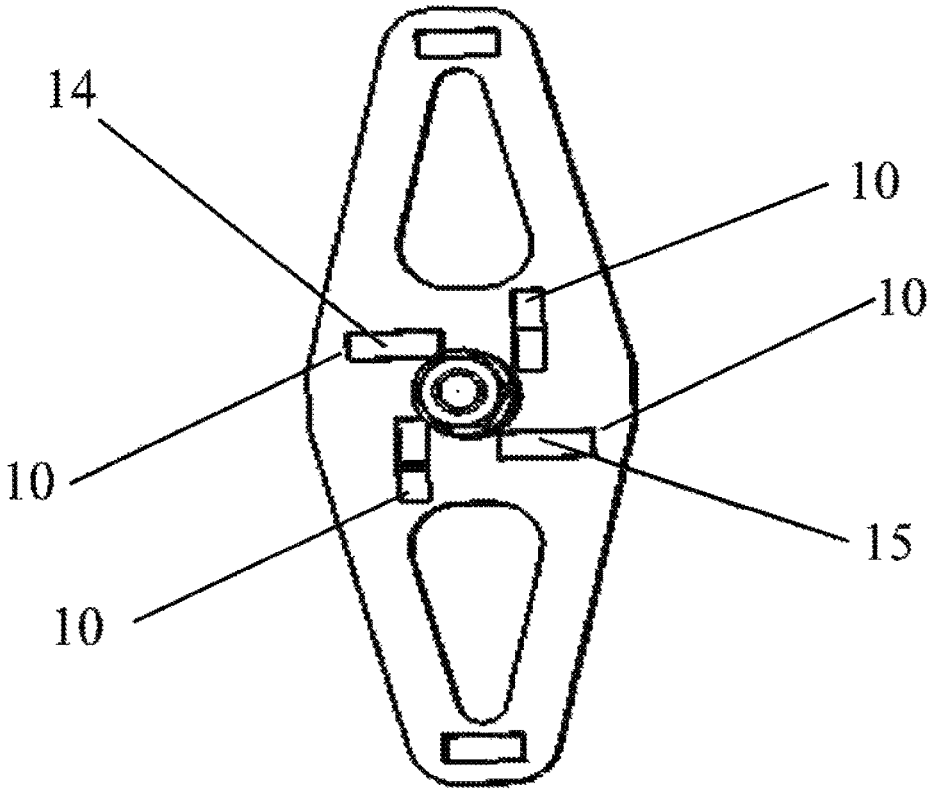
FIG. 6*c* is a plan view of a claw according to FIG. 6*a*.
Figure 6D:
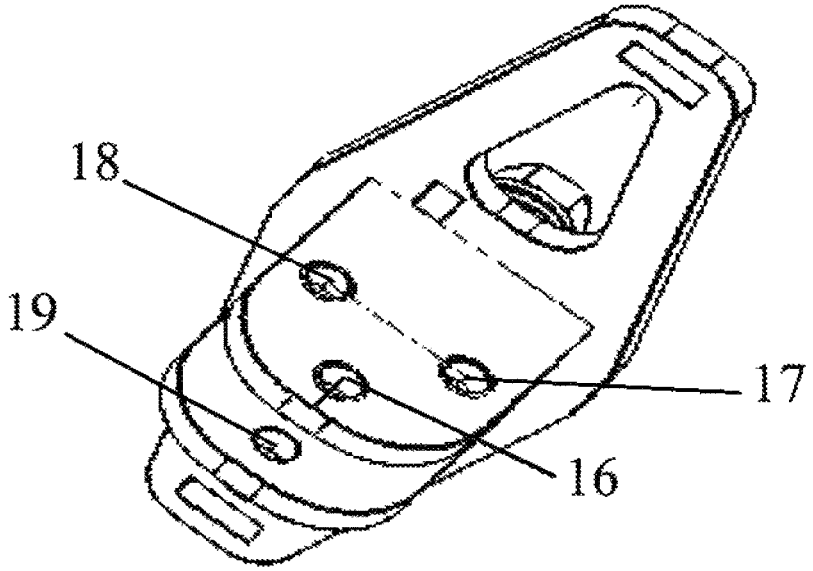
FIG. 6*d* is a perspective view of a claw according to FIG. 6*a*.

In FIG. 5

Another shape of a claw (1 and 2) comprises a plane surface (31) that is folded in its center to form a channel-section followed by an angle of 110° having two openings (38, 39), two tabs (40 and 41) are folded at its ends through an angle of 110°, six holes (32, 33, 34, 35, 36, 37) are drilled in the channel-section, the holes (34 and 36) on the axis for receiving a bolt that keeps the two sides of the channel-section parallel, the holes (32, 33, 35, and 37) are tapped and are for receiving four screws that serve to block the flukes of the anchor.

In FIGS. 6*a*, 6*b*, 6*c*, and 6*d*

Another shape of claw (1 and 2) that is retractable for stowage, a tapped shaft is welded to the middle of the web of the channel-section (4), which section has lugs (14 and 15), a part 2 that has a hole in its center is placed on said shaft, the part having openings (10, 11) corresponding to the lugs, the claw (2) is held in position by the lugs against the part 4 by a spring (13) that is compressed by a nut (12).

The channel-section (4) is pierced by four holes. The holes 16 and 19 are for receiving a bolt fastened through the drilled anchor, two holes 17 and 18 are tapped in order to receive two screws that block the fluke on tightening.

Figure 7:
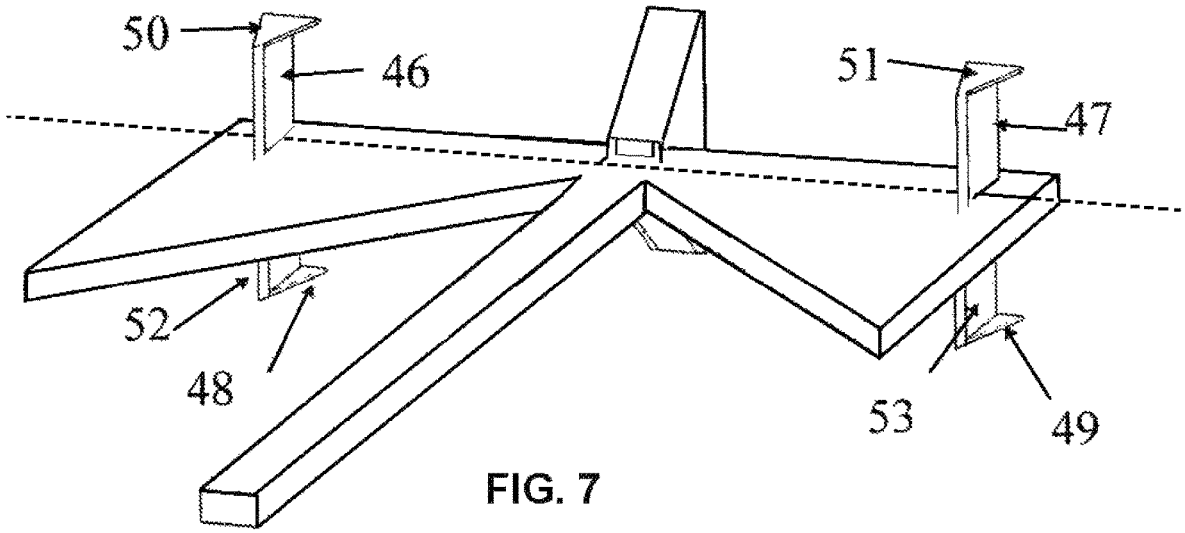
FIG. 7 is a perspective view of an anchor according to an embodiment.

In FIG. 7

Another shape of a claw molded on the stockless anchor, said claws have respective surfaces (46, 47, 52, 53) that are parallel to the shank (5) and perpendicular to the surfaces of the flukes and also plane surfaces at their ends (50, 51, 48, 49) that are parallel to the surfaces of the flukes. The claw may comprise a main surface forming an angle with the plane of the fluke. The angle may be perpendicular or acute.

Figure 8A:
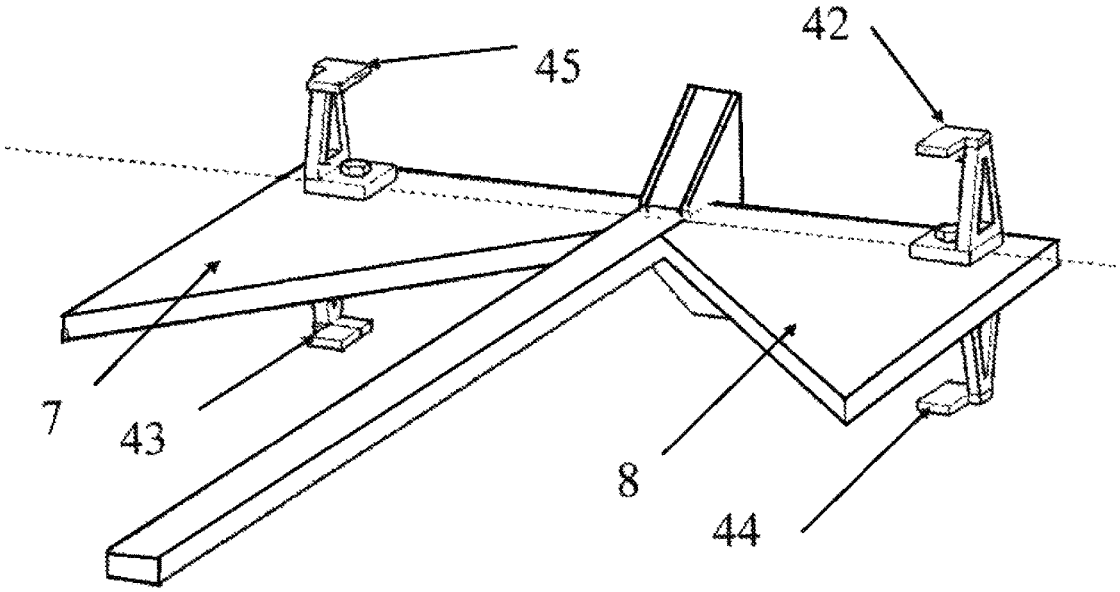
FIG. 8*a* is a perspective view of an anchor according to an embodiment.

In FIG. 8*a*

There can be seen another way of mounting claws, four half-claws (42, 45, 43, 44) are placed on either side of the drilled flukes at equal distances from the shank.

Figure 8B:
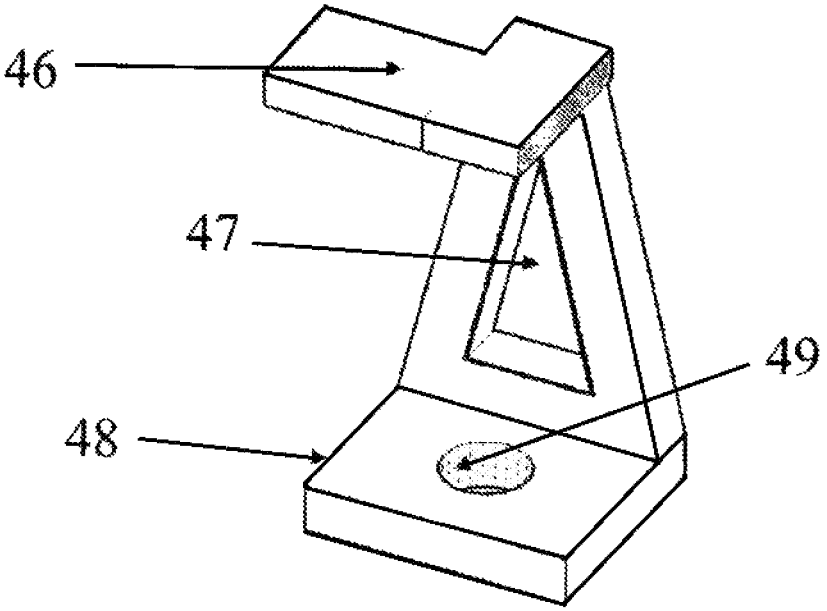
FIG. 8*b* is a perspective view of a half-claw according to another embodiment.

In FIG. 8*b*

There can be seen half-claws that are folded at their ends through an angle of 90°, one end of the half-claw (48) is pierced by a hole in order to be fastened together with the other half-claw on the anchor by a bolt.

The other end of the half-claw (46) is folded through 90° in order to provide a plane end.

An opening (47) provides a passage through the half-claw.

If the half-claw is fastened behind the pivot axis of the fluke, the plane portion (46) needs to be very long in order to be located either on the pivot axis of the fluke.

Figure 9:
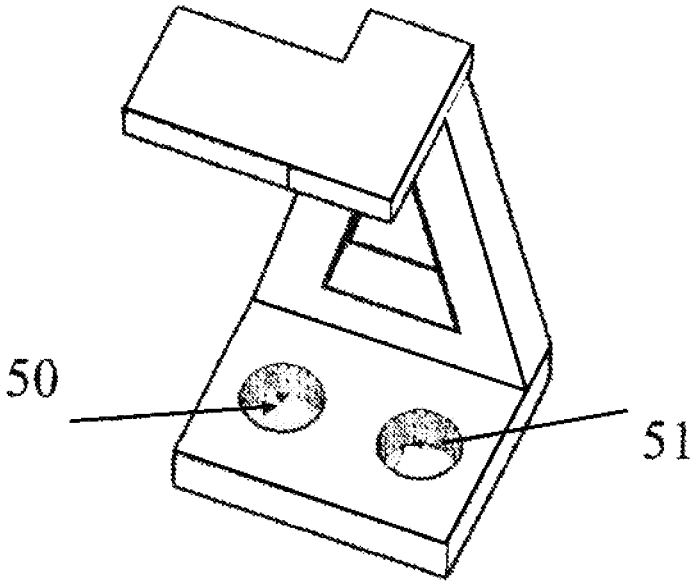
FIG. 9 is a perspective view of the half-claw of FIG. 8*b*.

In FIG. 9

There can be seen the same half-claw as in FIG. 8, but shown with two fastener holes (50 and 51) that improve the stability of the claws.

In FIG. 10

There can be seen several possible claw shapes (FIG. 10*a*, FIG. 10*b*, FIG. 10*c*, FIG. 10*d*) that may be welded, molded, or bolted on the flukes of the anchor.

FIG. 10*a*—the body of the claw (52) is cylindrical and has a plane surface (53) at its end.

FIG. 10*b*—the body of the claw is cylindrical and is terminated by the surface of the cylinder.

FIG. 10*c*—the body of the claw is polygonal and has a plane surface at its end.

FIG. 10*d*—the body of the claw is polygonal and is terminated by the surface of the polygon.

FIG. 10*e*—the body of the claw is cylindrical, the resulting spur being formed at an angle relative to the (x, z) plane.

In FIG. 11

There can be seen the behavior of the anchor on a hard bottom. The claws bear against it and give an optimum penetration angle to the flukes. They become buried directly in the floor.

In FIG. 12

There can be seen the behavior of the anchor on a sandy bottom. The plane surfaces of the claws prevent them initially from becoming completely buried, and subsequently cause the flukes to pivot in the sand, at a maximum angle.

Figure 13:
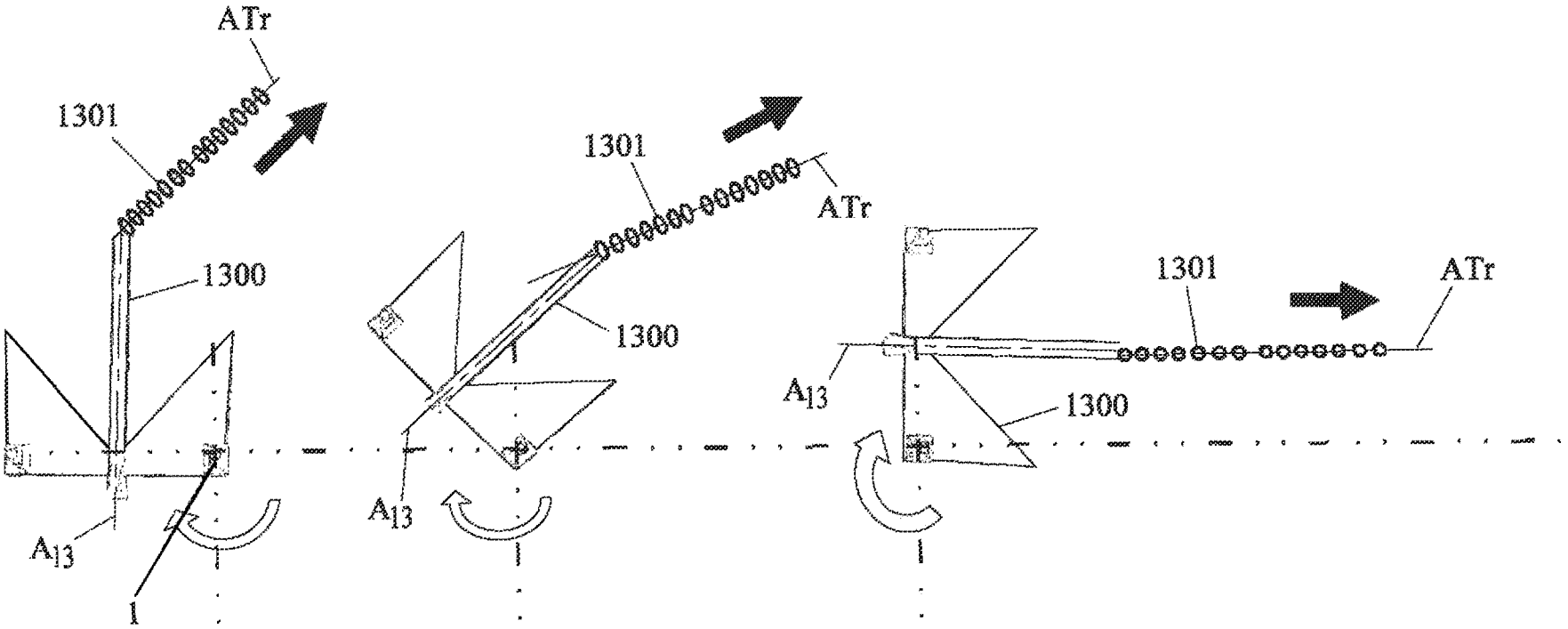
FIG. 13 is an elevational view of a claw according to another embodiment.

In FIG. 13

There can be seen the behavior of the anchor when seen from above on the bottom, when traction is not along the shank.

The anchor pivots horizontally about the axis situated at the claw 1 until the traction axis becomes aligned with the axis of the shank.

With reference to these drawings, the claws may be of various sizes, in proportion with the sizes of anchors, such that the height of the claws is greater than the height of the crown (6), with the claws being made of stainless or galvanized metal.

Users May Fasten Claws in Four Ways

1) By using the claws of FIG. 3, if the thickness of the fluke fits exactly in the channel-type section (4) without leaving any space, they need to fill holes in the anchor having the same diameter as the holes and insert two bolts in order to fasten the channel-sections (3 and 4) on the flukes.

2) Using the claws of FIG. 4, they need to drill the flukes of the anchor and insert two bolts for fastening to the channel-sections (3 and 4). If while inserting the flukes into the channel-type section any clearance remains between the flukes and the channel-type section, the screws in the holes 28 and 29 serve to press the flukes against the part 25.

3) Using the claws of FIG. 5, they can block the anchor without drilling using four screws, in order to hold the flukes (7 and 8) captive in the channel-sections (3 and 4).

4) Using the half-claws of FIGS. 9 and 10, they are fastened using one or more bolts in symmetrical manner on the flukes, on either side of the fluke and at the same distance from the shank, one under the other.

The retractable version (FIG. 6) enables the claws (1 and 2) to be folded flat parallel to the flukes, so as to enable the anchor to be stored in a locker without occupying up too much space (FIGS. 6*a*, 6*b*, 6*c*, 6*d*). The claws may be retracted such that ends of the claws are placed in the proximity of the planes of or defined by the flukes.

The drawings are given as examples and the claws may have other shapes providing the essential characteristics of said claws are conserved (three-dimensional (x, y, z) claws fitted onto a stockless anchor on the tilt axis of the flukes having a vertical dimension (y) that is predominant over the other two dimensions in order to form a shaped spur, said shaping serving to facilitate penetration of the claw into the sea floor when traction (x) is applied to the anchor).

The device of the invention is particularly intended to provide opening, effectiveness, and stability for the flukes of the anchor on the floor, immediately once the vessel pulls away. This has the consequence of preserving the ecosystem of sea bottoms, and of increasing the safety of sailors by considerably reducing anchors turning over, becoming detached, and dragging.

The invention claimed is:

1. A stockless anchor comprising:

two flukes pivotally mounted on a shank; and a crown;

the stockless anchor being characterized by claws fastened on flanks of each fluke of the crown, said claws extend in three dimensions (x, y, z) with a vertical dimension (y) that is preponderant over length and width dimensions (x, z), the claws being placed on a pivot axis of the flukes;

wherein the claws comprise a plane vertical surface including openings.

2. The stockless anchor according to claim 1, wherein the claws are placed on the pivot axis (z) of the flukes, with ends of the claws being positioned on the pivot axis of the flukes.

3. The stockless anchor according to claim 1, wherein the claws include at least one fastener tab, the at least one fastener tab is pierced and secured to the flukes by threaded systems.

4. The stockless anchor according to claim 1, wherein the claws are created by molding during fabrication.

5. The stockless anchor according to claim 1, wherein the claws are welded to the stockless anchor while the stockless anchor is being fabricated.

6. The stockless anchor according to claim 1, wherein the claws have plane surfaces at their ends.

7. The stockless anchor according to claim 1, wherein the claws have points configured to facilitate attachment of the flukes in a floor.

8. The stockless anchor according to claim 1, wherein the claws are retractable for stowage.

9. The stockless anchor according to claim 1, wherein the claws are made up of an assembly of half-claws.

10. A stockless anchor comprising:

two flukes pivotally mounted on a shank; and a crown;

the stockless anchor being characterized by claws fastened on flanks of each fluke of the crown, said claws extend in three dimensions (x, y, z) with a vertical dimension (y) that is preponderant over length and width dimensions (x, z), the claws being placed on a pivot axis of the flukes;

wherein the claws are retractable for stowage.

11. A stockless anchor comprising:

two flukes pivotally mounted on a shank; and a crown;

the stockless anchor being characterized by claws fastened on flanks of each fluke of the crown, said claws extend in three dimensions (x, y, z) with a vertical dimension (y) that is preponderant over length and width dimensions (x, z), the claws being placed on a pivot axis of the flukes;

wherein the claws include at least one fastener tab, the at least one fastener tab is pierced and secured to the flukes by threaded systems.

* * * * *